US007845148B2

(12) United States Patent
Ramnarain et al.

(10) Patent No.: US 7,845,148 B2
(45) Date of Patent: Dec. 7, 2010

(54) METHOD AND APPARATUS FOR INSERTION OF UNIQUELY SHAPED PACKAGING ELEMENTS

(75) Inventors: David R. Ramnarain, Shakopee, MN (US); Brian D. Ramnarain, Shakopee, MN (US); Christopher D. Ramnarain, Shakopee, MN (US)

(73) Assignee: PSR Automation Incorporated, Shakopee, MN (US)

( * ) Notice: Subject to any disclaimer, the term of this patent is extended or adjusted under 35 U.S.C. 154(b) by 0 days.

(21) Appl. No.: 12/103,443

(22) Filed: Apr. 15, 2008

(65) Prior Publication Data

US 2009/0255217 A1 Oct. 15, 2009

(51) Int. Cl.
*B65B 7/28* (2006.01)

(52) U.S. Cl. ..... 53/485; 53/490; 53/317; 53/319; 53/331.5

(58) Field of Classification Search ..... 53/484, 53/485, 490, 310, 312, 317, 319, 321, 322, 53/331.5

See application file for complete search history.

(56) References Cited

U.S. PATENT DOCUMENTS

| | | | | | |
|---|---|---|---|---|---|
| 2,781,576 | A * | 2/1957 | Jennings | 53/319 |
| 3,141,278 | A * | 7/1964 | Wysocki | 53/319 |
| 3,212,173 | A * | 10/1965 | Wonneman | 53/319 |
| 3,248,785 | A * | 5/1966 | Aidlin | 53/319 |
| 3,269,084 | A * | 8/1966 | Stiefel, Jr. | 53/319 |
| 3,360,844 | A * | 1/1968 | Wonneman | 53/319 |
| 4,199,914 | A * | 4/1980 | Ochs et al. | 53/317 |
| 4,611,454 | A | 9/1986 | Proepper | |
| 4,817,363 | A * | 4/1989 | St. Clair | 53/319 |
| 4,866,907 | A | 9/1989 | Iuchi et al. | |
| 4,982,554 | A | 1/1991 | Corniani | |
| 5,207,048 | A | 5/1993 | Wysocki | |
| 5,467,527 | A | 11/1995 | Zanini et al. | |
| 5,479,762 | A | 1/1996 | Bliss | |
| 5,584,161 | A | 12/1996 | Zanini et al. | |
| 5,915,526 | A | 6/1999 | Dewees et al. | |
| 6,857,250 | B1 * | 2/2005 | Taylor | 53/485 |
| 2007/0193226 | A1 * | 8/2007 | Jalbert | 53/331.5 |
| 2008/0010946 | A1 * | 1/2008 | Srether | 53/331.5 |

* cited by examiner

*Primary Examiner*—Louis K Huynh
(74) *Attorney, Agent, or Firm*—Thomas J. Nikolai; Nikolai & Mersereau, P.A.

(57) ABSTRACT

In some embodiments, a method of insertion of uniquely shaped packaging elements may include one or more of the following steps: (a) transporting a container along a conveyor, (b) securing the container, (c) aligning a spray cap mechanism over a container opening with a transfer rake assembly, (d) grasping a diptube with a diptube assembly, (e) lowering the diptube assembly and the transfer rake assembly to insert the diptube into the container, (f) securing the container with a timing screw, (g) loading the spray cap mechanism into a sprayer magazine, (h) locking a retractable stop onto the spray cap mechanism, (i) transferring the spray cap mechanism from the sprayer magazine to the transfer rake, (j) locking a second spray cap mechanism with the retractable stop, and (k) retracting the diptube assembly after inserting the diptube into the container.

12 Claims, 6 Drawing Sheets

METHOD AND APPARATUS FOR INSERTION OF UNIQUELY SHAPED PACKAGING ELEMENTS

BACKGROUND OF THE INVENTION

I. Field of the Invention

Embodiments of the present invention relate to packaging equipment. Particularly, embodiments of the present invention relate to an apparatus for applying closures to containers. More particularly, embodiments of the present invention relate to an apparatus capable of inserting long, flexible packaging elements, such as a spray pump, accurately into a bottle.

II. Discussion of Related Art

A spray bottle is a bottle capable of squirting, spraying, or misting fluids. A common use for spray bottles is dispensing cleaners, cosmetics, and chemical specialties. While spray bottles existed before the middle of the 20th century, they used a rubber bulb, which was squeezed and the quickly-moving air siphoned fluid from the bottle. The rapid improvement in plastics after World War II increased the range of fluids able to be dispensed, and reduced the cost of the sprayers because assembly could be fully automated.

The Drackett Company, manufacturers of Windex® glass cleaner, was a leader in promoting spray bottles. Roger Drackett raised soybeans, converted the soybeans to plastic using technology purchased from Henry Ford, and was an investor in the Seaquist Company, an early manufacturer of sprayers and closures. Initially, the brittle nature of early plastics required sprayers be packaged in a cardboard box, and the sprayer inserted in the glass Windex® bottle by the consumer. The cost of sprayers was also a factor. Consumers would reuse the sprayers with bottle after bottle of glass cleaner. As plastics improved, and the cost of sprayers dropped, manufacturers were able to ship product with the sprayer already in the bottle.

In the late 1960s, spray bottles with trigger-style actuators appeared and quickly became popular, as it was less fatiguing to use. The original pump-style bottle remained more popular for applications like non-aerosol deodorants, where size was a factor, and repeated pumps were not required. Unlike the rubber bulb dispenser which primarily moved air with a small amount of fluid, modern spray bottles use a positive displacement pump acting directly on the fluid. The pump draws liquid up a siphon tube from the bottom of the bottle, and the liquid is forced out a nozzle. Depending on the sprayer, the nozzle may or may not be adjustable, so as to select between squirting a stream, aerosolizing a mist, or dispensing a spray.

The dispensing is powered by the user's efforts in a spray bottle, as opposed to the spray can, in which the user simply actuates a valve, and product is dispensed under pressure, using a liquid gasifying at room temperature and pressure such as propane/isobutane blends or Freon, or pressured gasses such as nitrous oxide or ordinary air.

Plastic bottles are an increasingly important form of packaging in the world today. The durability and convenience they provide is recognized by persons in virtually all segments of societies. In manufacturing plants specializing in filling liquid products into a bottle, it is usually common practice to place some type of cover (such a cap, lid, or, seal) on the bottle to prevent leakage, contamination of product, etc. The entire process of loading the bottle, filling the bottle, capping the bottle (putting on the protective cover), and packaging the final product can be done automatically.

However, there arises a special situation in which this automatic procedure can be hampered, and this is when a sprayer pump must be inserted into a bottle. A sprayer pump is a special component fitted on a bottle allowing for the liquid in the bottle to be pressurized and "sprayed". It is composed of a body, handle, tube, pump, and nozzle.

Spray bottles typically include a container having a threaded opening at the top. Secured to the threaded top is a threaded cap integrally formed with a pump mechanism. Attached to the pump mechanism is a tube extending from the pump mechanism to the bottom of the container. This tube is used to draw liquid from the bottom of the container to the pumping mechanism. The sprayer pump also functions as the cover of the bottle.

Automatic capping machines are well known in the bottling industry. They are often used to apply the lid or cap to a jar or bottle as part of a filling operation. However, automatic capping machines have typically not been used with spray bottles because of the difficulty in positioning the cap given the tube extending from the cap. There has been no reliable way to ensure the tube will pass through the opening of the container when such automated capping equipment is used. As such, spray bottles have typically been capped by hand rather than in an automated fashion.

A particular problem with automatically inserting sprayer pumps into a bottle is the sprayer pump tube commonly becomes bent during, manufacture, and will miss the opening on the bottle entirely during insertion, because the opening on the bottle is restrictive in size. While the sprayer pump tube is straight at the top of the pump assembly, it is most likely bent at the bottom of the tube. This is particularly a problem in linear mechanical systems in which the machine is capable of only a single up/down movement, and has no feedback about the current configuration of the sprayer pump or tube. This has led to manufacturers using manual labor to insert the sprayer pump accurately, or very complex and expensive machinery to perform the task, which in turn yields reduced profits especially during small production runs.

Therefore, it would be desirable to have a simplified and more robust manner to automatically orientate and straighten the sprayer pumps for insertion into the bottle.

SUMMARY OF THE INVENTION

In some embodiments, a method of insertion of uniquely shaped packaging elements may include one or more of the following steps: (a) transporting a container along a conveyor, (b) securing the container, (c) aligning a spray cap mechanism over a container opening with a transfer rake assembly, (d) grasping a diptube with a diptube assembly, (e) lowering the diptube assembly and the transfer rake assembly to insert the diptube into the container, (f) securing the container with a timing screw, (g) loading the spray cap mechanism into a sprayer magazine, (h) locking a retractable stop onto the spray cap mechanism, (i) transferring the spray cap mechanism from the sprayer magazine to the transfer rake, (j) locking a second spray cap mechanism with the retractable stop, and (k) retracting the diptube assembly after inserting the diptube into the container.

In some embodiments, a method of insertion of uniquely shaped packaging elements may include one or more of the following steps: (a) securing a container in a predetermined location, (b) removing a spray cap mechanism from a sprayer magazine and aligning the spray cap mechanism over a container opening on the container, (c) grasping a diptube with a diptube assembly, (d) inserting the diptube into the container opening, (e) retracting the diptube assembly after the diptube is inserted into the container opening, (f) lowering the spray cap mechanism onto the container opening with a transfer rake, (g) tightening the spray cap mechanism onto the container opening, with a turn-belt, (h) retracting the turn-belt after tightening the spray cap mechanism, and (i) retracting the transfer rake after tightening of the spray cap mechanism.

In some embodiments, an apparatus for insertion of uniquely shaped packaging elements may include one or more of the following features: (a) a securing mechanism to hold a container along a conveyor in a predetermined location, (b) a cap transfer rake which removes a spray cap mechanism from a sprayer magazine and aligns the spray cap mechanism over a container opening on the container, (c) a diptube assembly which locks a diptube hanging from the spray cap mechanism, (d) a turn-belt which tightens the spray cap mechanism, held by the cap transfer rake, on the container opening after the diptube is inserted into the container opening by the diptube assembly, (e) a support rake operably coupled to the cap transfer rake, (f) a diptube slot located in the top and bottom plate of the diptube assembly, (g) a slot located adjacent to the diptube slot on the top plate of the diptube assembly, (h) a retractable stop operably coupled to the sprayer magazine, and (i) a pocket on the timing screw to hold the container in the predetermined location.

DESCRIPTION OF PREFERRED EMBODIMENT

Figure 1:
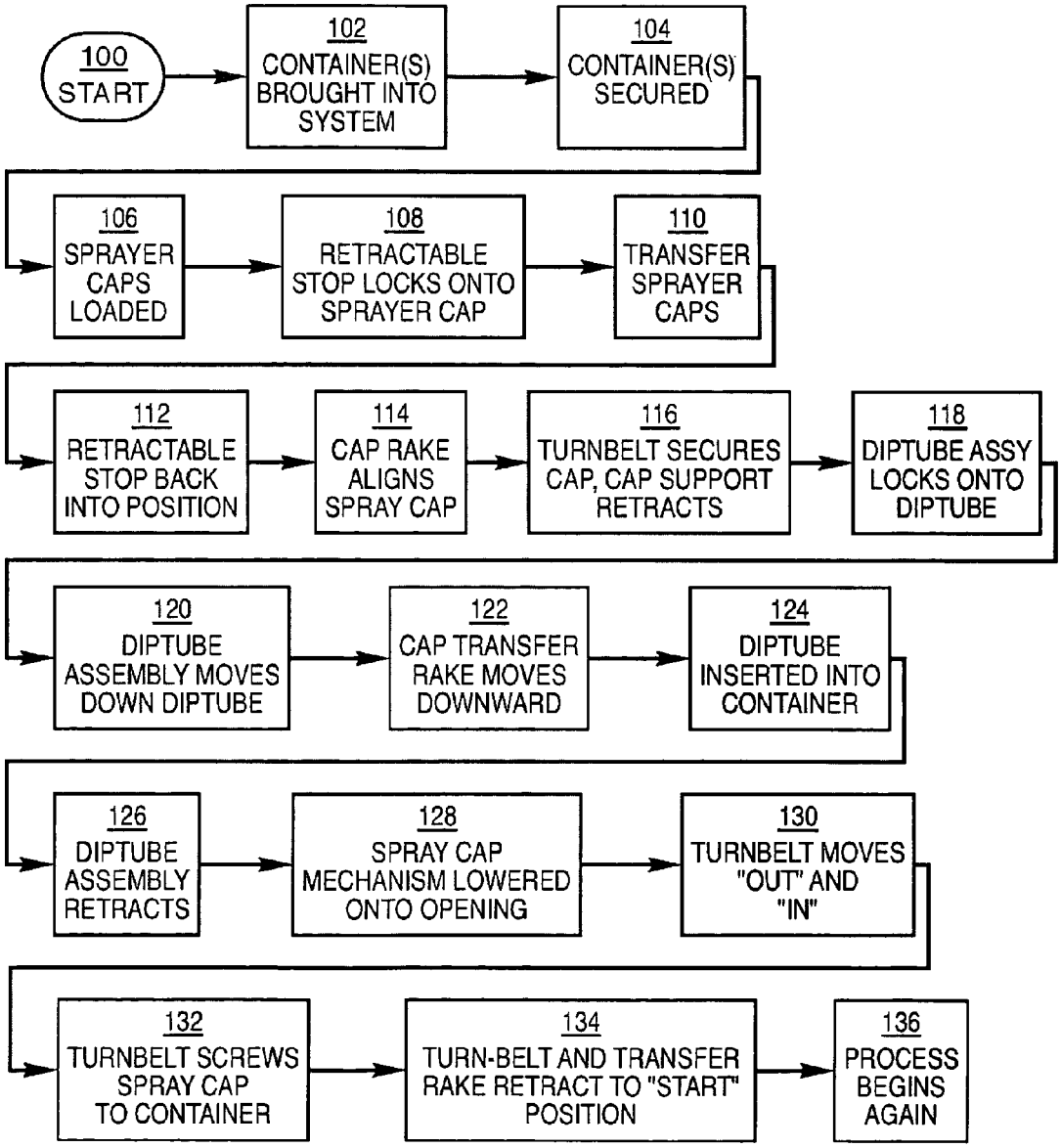
FIG. 1 shows a flow chart diagram of a method of insertion of uniquely shaped packaging elements in an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings.

Embodiments of the present invention provide an apparatus able to be used in the production of packaged items. More specifically, the apparatus of the present invention can straighten and correctly orientate the flexible tube of a sprayer pump.

Embodiments of the present invention are ideally suited for use in capping spray bottles. Embodiments of the present invention enable a plurality of bottles to be quickly filled, the tubes of the spray mechanism to be inserted into the opening on the bottles, and the cap to be tightened onto the bottles in such a, way there is no risk the bottles will tip, the tube will not be properly inserted, or cross-threading will occur in tightening the cap onto the bottle.

With continued reference throughout this discussion to FIG. 1, a flow chart diagram of a method of insertion of uniquely shaped packaging elements in an embodiment of the present invention is shown. While the present discussion is given with respect to placing spray cap mechanisms within bottles, it is fully contemplated embodiments of the present invention could be extended to most any packaging element and methods of packaging elements without departing from the spirit of the invention.

At state 102, container(s) 2 are brought into packaging system 4 (FIG. 2) along conveyor 6. Container(s) 2 can be inputted into packaging system 4 in predetermined groups. For purposes of the present discussion, container(s) 2 are loaded, into packaging system 4 in groups of twelve. For purposes of the present discussion container(s) 2 can have a neck 26 narrower than body 28 and a "mouth"/container opening 24. Container(s) 2 can be made of glass, clay, plastic or other impervious materials, and can be used to store liquids such as water, milk, soft drinks, beer, wine, cooking oil, medicine, shampoo, ink, etc.

Figure 2:
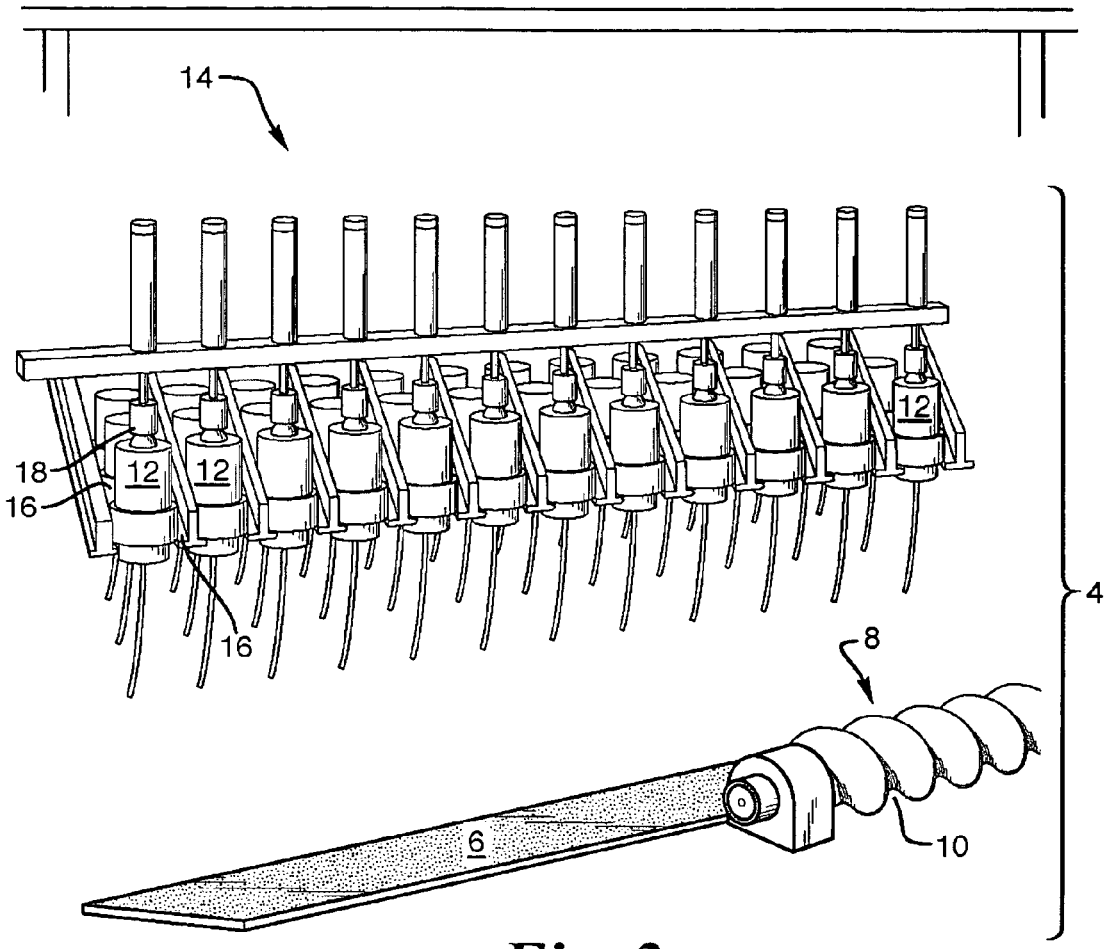
FIG. 2 shows a front end section of a packaging system in an embodiment of the present invention.

With reference to FIG. 2, a front end section of a packaging system 4 in an embodiment of the present invention is shown. Conveyor 6 routes container(s) 2 to timing screw 8 where container(s) 2 will be held in place in a predetermined location by timing screw 8 at state 104 (see FIG. 3). Conveyor 6 can be a belt conveyor consisting of two or more pulleys, with a continuous loop of material (e.g., the conveyor belt rotating about them). One or both of the pulleys can be powered, moving the belt and container(s) 2 on the belt forward. The powered pulley is called the drive pulley while the unpowered pulley is called the idler.

Figure 3:
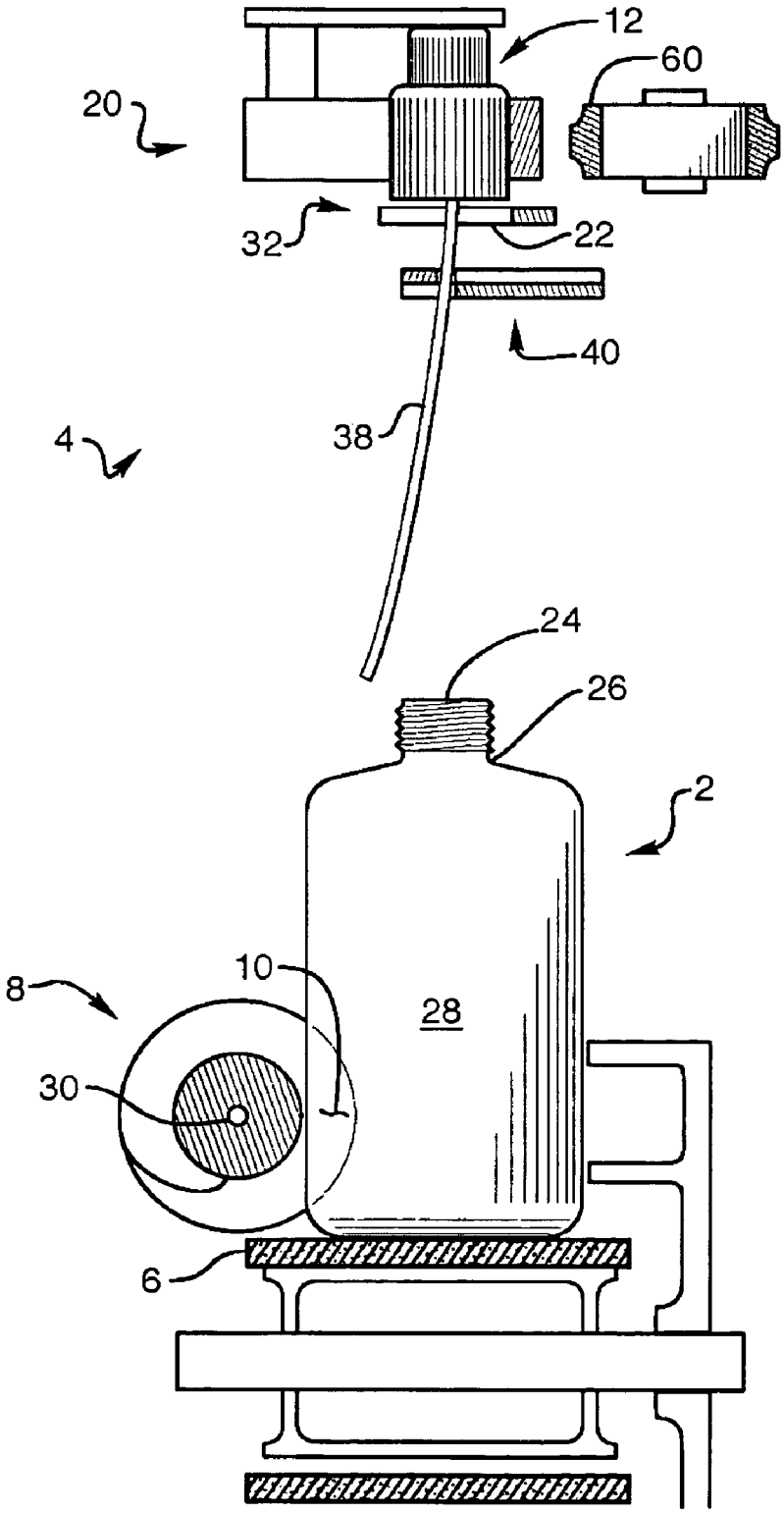
FIG. 3 shows an side view of a packaging system in an embodiment of the present invention.

With reference to FIG. 3, a side view of a packaging system 4 in an embodiment of the present invention is shown. Timing screw 8 ensures container(s) 2 do not move during operation of packaging system 4. Timing screw 8 can be used to move container(s) 2 by a rotating helical flighting. Container(s) 2 can be moved along an axis of rotation 30. As shown, the flighting is not encased. Timing screw 8 rotates, and in doing so, moves a container(s) 2 down along axis 30 with container (s) 2 within pocket 10 which holds container(s) 2 at an equidistant location from one another. This, distance coincides with the distance between each spray cap mechanism 12.

A supply of spray cap mechanisms 12 can be loaded into the rear of packaging system 4 in a sprayer magazine 14 at state 106. Spray cap mechanisms 12 can be loaded at any, time throughout the operation of packaging system 4; thus, the location of state 106 throughout operation of packaging system 4 is no way limited to its orientation as shown in FIG. 1. Spray cap mechanisms 12 can be divided into channels 16 within sprayer magazine 14. Gravity forces spray cap mechanisms 12 to fall down through channel 16 until spray cap mechanisms 12 are eventually held in place by retractable stop 18 at state 108. Retractable stop 18 can be pneumatically controlled. Thus, when spray cap mechanisms 12 encounter retractable stop 18 a positive pressure is provided to keep spray cap mechanisms 12 in place until cap transfer rake 20 slides up and grasps the front row of spray cap mechanisms 12.

Once container(s) 2 are held in place by timing screw 8 (discussed above), retractable stop 18 retracts allowing a predetermined number of spray cap mechanisms 12 to transfer to a cap transfer rake 20 at state 110. Retractable stop 18 can then move back into its original position preventing remaining spray cap mechanisms 12 from entering, cap transfer rake 20 at state 112. Cap transfer rake 20 holds spray cap mechanisms 12 firmly in place.

Figure 4:
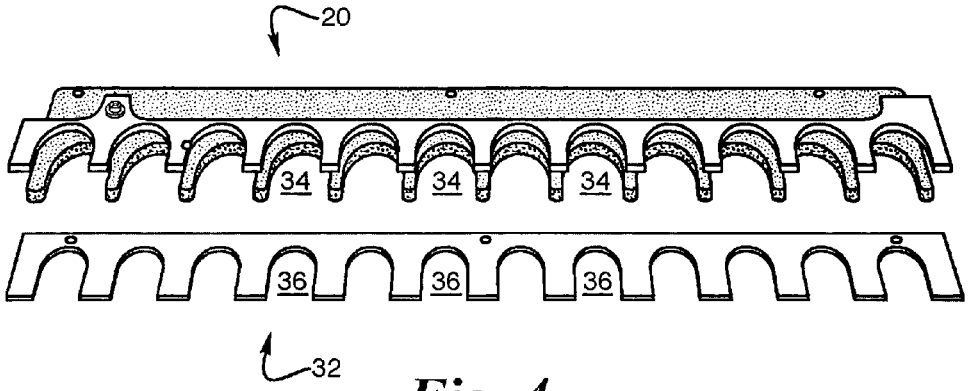
FIG. 4 shows an elevated view of a cap transfer and support rake in an embodiment of the present invention.

With reference to FIG. 4, an elevated view of cap transfer rake 20 and cap support rake 32 in an embodiment of the present invention is shown. Cap transfer rake 20 and cap, support rake 32 transport spray cap mechanisms 12 to a predetermined spot above and aligned with a respective container(s) 2 with center 22, of the spray cap mechanism 12 above container openings 24 at state 114. Each spray cap mechanism 12 is held within spray cap holder 34 where the bottom of spray cap mechanism 12 is held and supported by support holder 36. Support holders 36 allow enough room for diptubes 38 to pass through but are small enough to allow spray cap mechanisms 12 to rest easily upon the top of cap support rake 32. At state 116, turn-belt 60 moves inward toward spray cap mechanisms 12 until turn-belt 60 contacts spray cap mechanisms 12 preventing it from moving while cap support rake 32 retracts.

Figure 5:
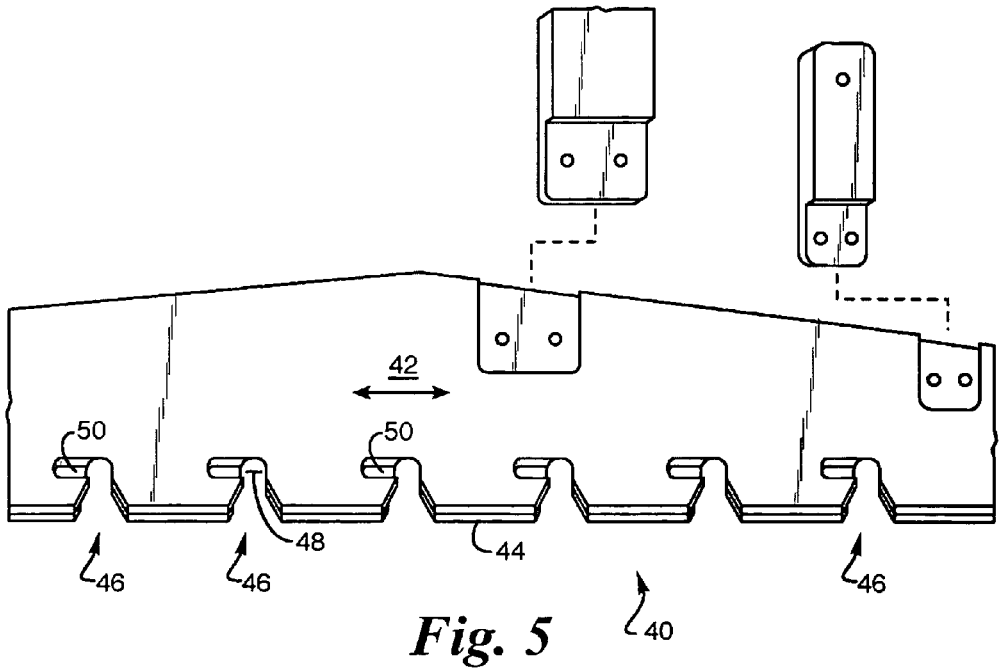
FIG. 5 shows an elevated view of a diptube grabber assembly in an embodiment of the present invention.
Figure 6:
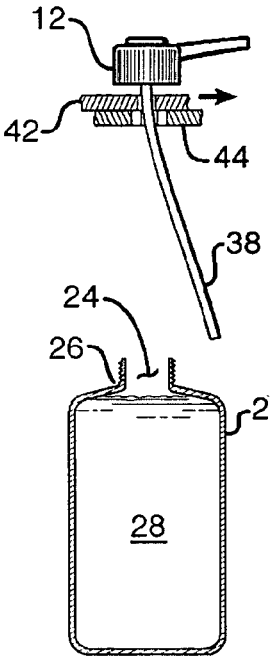
FIGS. 6-11 show a diptube being inserted into a container in an embodiment of the present invention.
Figure 7:
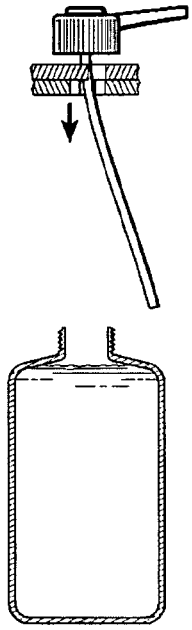
Figure 8:
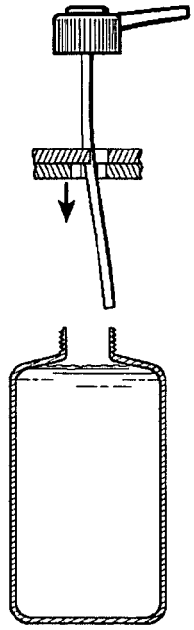
Figure 9:
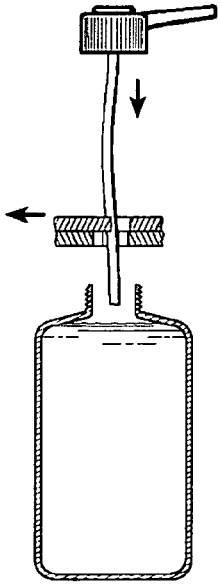
Figure 10:
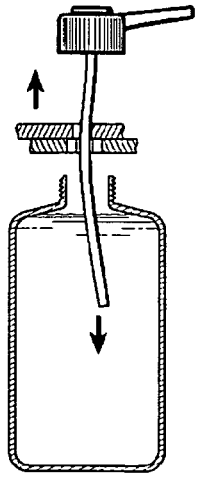
Figure 11:
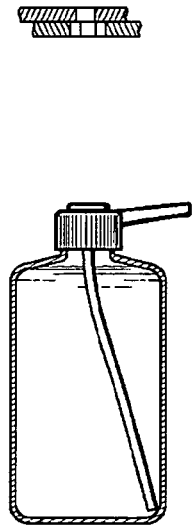

With reference to FIG. 5, an elevated view of a diptube grabber assembly 40 in an embodiment of the present invention is shown. At state 118, diptube grabber assembly 40 moves inward toward diptubes 38 associated with each of spray cap mechanism 12 being held in place by cap transfer rake 20 and grasps the uppers portion of each diptube 38 (FIGS. 6 and 7). Diptube grabber assembly 40 has a sliding top plate 42 and a stationary bottom plate 44. Both top plate 42 and bottom plate 44 have V-shaped diptube slots 46 in which to receive diptubes 38. V-shaped slot 46 enables centering of diptube 38 by forcing diptube 38 into narrow recess 48. Diptube 38 is captured and held in place by sliding top plate 42 sliding to the right and capturing diptube 38 within slot 50. It is fully contemplated cap transfer rake 20 and cap support rake 32 and diptube grabber assembly 40, could be operated by electrical pneumatics and/or hydraulics without departing from the spirit of the invention.

With reference to FIGS. 6-11, a diptube 38 being inserted into a container 2 in an embodiment of the present invention is shown. At state 120, diptube grabber assembly 40, while holding diptubes 38 between top plate 42 and bottom plate 44, moves downward (FIGS. 8 and 9) until diptube grabber assembly 40 is approximately one inch, from the bottom of diptube 38. This action by diptube grabber assembly 40 causes diptube 38 to straighten (FIG. 9), easing entry of diptube 38 into container opening 24 of container(s) 2. The combination of cap transfer rake 20 moving downward at state 122 while diptube grabber assembly 40 moves upward, causes diptube 38 to be inserted into container 2 at state 124. Once diptube grabber assembly 40 has inserted diptube 38 in container 2 it retracts away from container 2 at state 126. Cap transfer rake 20 continues to move downward until spray cap mechanism 12 reaches container opening 24 at state 128.

Figure 12:
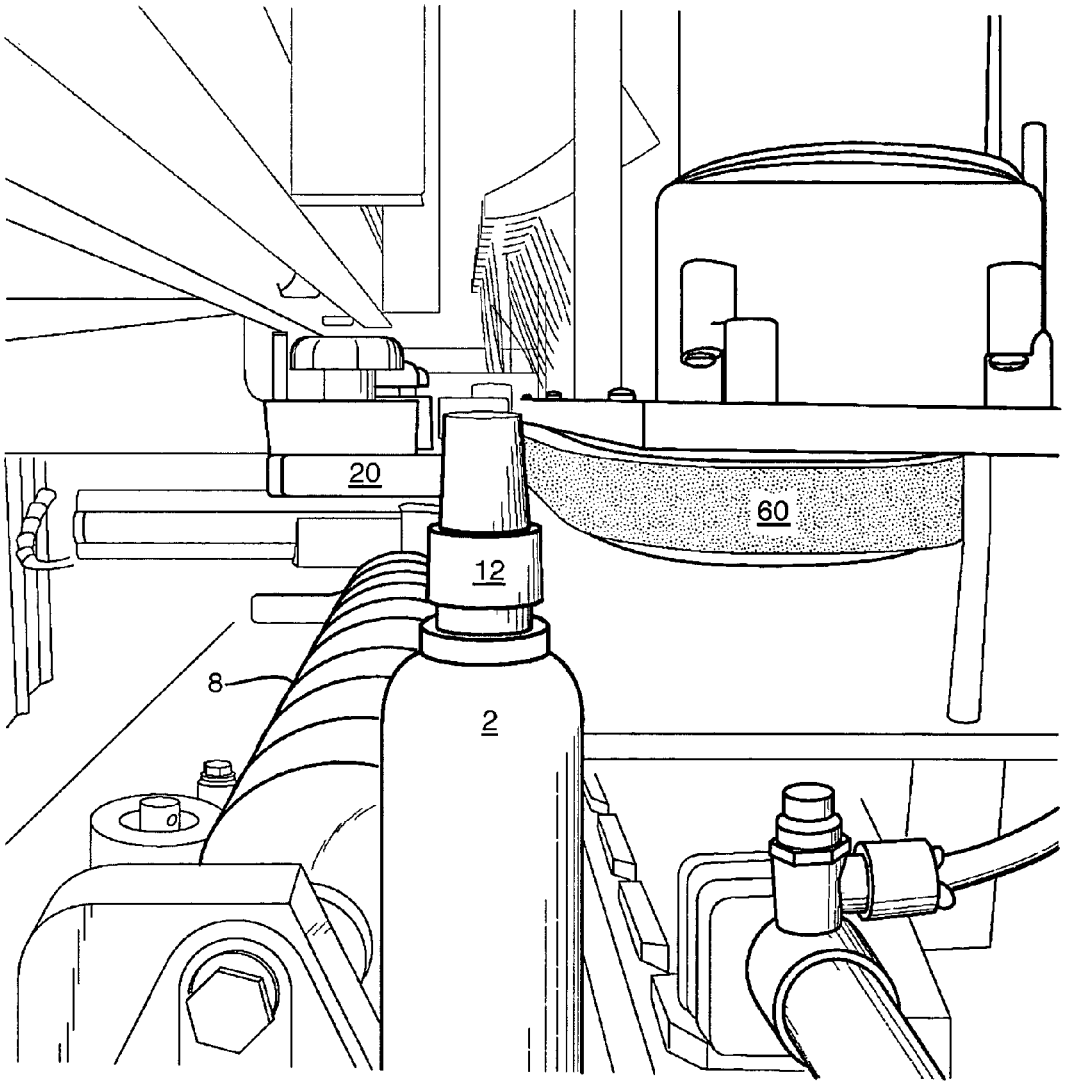
FIG. 12 shows a side view of a packaging system in an embodiment of the present invention.

With reference to FIG. 12, a side view of a packaging system 4 in an embodiment of the present invention is shown. At state 130, turn-belt 60 move, outward and releases spray cap mechanisms 12 onto container(s) 2 and then inward again once again adjacent to spray cap mechanisms 12. Turn-belt 60 then moves in a first direction causing spray cap mechanisms 12 to rotate in a direction opposite to the internal threads on spray cap mechanisms 12 at state 130. Turn-belt 60 then moves in the opposite direction screwing spray cap mechanisms 12 to container(s) 2 at state 132. This dual direction action prevents cross-threading. After spray cap mechanisms 12 are completely threaded onto container(s) 2, turn-belt 60 and cap transfer rake 20 retract and the closed container(s) 2 are removed from packaging system 4 via motorized conveyor 6 at state 134.

For purposes of the present disclosure, it is assumed spray cap mechanisms 12 are already present/loaded in, sprayer magazine 14 by some other method not discussed in the present discussion, e.g., this machine does not "sort" the sprayer pumps, but rather automatically inserts the sprayer pumps into a container 2. Container(s) 2 can be loaded, into packaging system 4 via motorized conveyor 6 and timing screw 8. After one cycle, the machine resets and the container (s) 2 will be removed by a motorized conveyor 6, and the process will repeat at state 136. The result is the fully automatic; inline nature the manufacturing line is preserved without complexity and excessive cost to the manufacturer. Accordingly, those skilled in the art will appreciate from the foregoing the present invention provides a simple solution for automatic insertion of sprayer pumps into their bottles.

There are many known types of bottles and sprayers. Packaging system 4 can be calibrated for each type of bottle. It is assumed though the prior listed procedure the end user has made all bottle and sprayer pump specific adjustments, so the machine functions optimally.

Thus, embodiments of the APPARATUS FOR INSERTION OF PACKAGING ELEMENTS are disclosed. One skilled in the art, will appreciate the present teachings can be practiced with embodiments other than those disclosed. The disclosed embodiments are presented for purposes of illustration and not limitation, and the present teachings are limited only by the following claims.

We claim:

1. A method of insertion of uniquely shaped packaging elements, comprising the steps of:

transporting simultaneously a first container and a second container along a single conveyor;

securing simultaneously the first and second containers on the single conveyor;

aligning simultaneously a first spray cap mechanism over a first container opening on the first container and a second spray cap mechanism over a second container opening on the second container with a transfer rake assembly;

grasping simultaneously a first diptube, which is coupled to and extends downward from the first spray cap mechanism and simultaneously grasping a second diptube, which is coupled to and extends downward from the second spray cap mechanism, with a diptube assembly;

lowering simultaneously the diptube assembly and the transfer rake assembly to simultaneously insert the first diptube into the first container and the second diptube into the second container; and rotating simultaneously the first spray cap mechanism to couple the first spray cap mechanism to the first container and simultaneously rotating the second spray cap mechanism to couple the second spray cap mechanism to the second container.

2. The method of claim 1, further comprising the step of securing the first and second containers with a timing screw.

3. The method of claim 2, further comprising the step of loading the first and second spray cap mechanisms into a sprayer magazine.

4. The method of claim 3, further comprising the step of locking a retractable stop onto the first and second spray cap mechanisms.

5. The method of claim 4, further comprising the step of transferring the first and second spray cap mechanisms from the sprayer magazine to the transfer rake.

6. The method of claim 5, further comprising the step of retracting the diptube assembly after inserting the first and second diptubes into the first and second containers respectively.

7. A method of insertion of uniquely shaped packaging elements, comprising the steps of:

securing simultaneously on a single conveyor a first container and a second container in a predetermined location;

removing simultaneously a first spray cap mechanism and a second spray cap mechanism from a sprayer magazine and aligning the first spray cap mechanism over the first container having a container opening and simultaneously aligning the second spray cap mechanism over the second container having a container opening, both the first and second containers being side by side on the single conveyor;

grasping simultaneously a first diptube, which is coupled to and extends downward from the first spray cap mechanism and a second diptube, which is coupled to and extends downward from the second spray cap mechanism, with a diptube assembly; and inserting simultaneously the first diptube into the first container opening and the second diptube into the second container opening.

8. The method of claim 7, further comprising the step of retracting the diptube assembly after the first and second diptubes are inserted into the first and second container openings.

9. The method of claim 8, further comprising the step of lowering the first and second spray cap mechanisms onto the first and second container openings with a transfer rake.

10. The method of claim 9, further comprising the step of tightening the first and second spray cap mechanisms onto the first and second container openings with a turn-belt.

11. The method of claim 10, further comprising the step of retracting the turn-belt after tightening the first and second spray cap mechanisms.

12. The method of claim 11, further comprising the step of retracting the transfer rake after tightening of the first and second spray cap mechanisms.

* * * * *